US005934678A

United States Patent [19]

Theissen et al.

[11] Patent Number: 5,934,678

[45] **Date of Patent: *Aug. 10, 1999**

[54] TARGET SYSTEM

[75] Inventors: Peter-Paul Theissen, Haan; Gerhard Lechner, Leverkusen, both of Germany

[73] Assignee: Sparing Rohl Henseler, Dusseldorf, Germany

[ * ] Notice: This patent issued on a continued prosecution application filed under 37 CFR 1.53(d), and is subject to the twenty year patent term provisions of 35 U.S.C. 154(a)(2).
This patent is subject to a terminal disclaimer.

[21] Appl. No.: 08/610,144

[22] Filed: Feb. 29, 1996

[30] Foreign Application Priority Data

Jan. 16, 1996 [DE] Germany ..... 196 01 380

[51] Int. Cl.[6] ..... F41J 1/10

[52] U.S. Cl. ..... 273/386; 273/406

[58] Field of Search ..... 273/406, 407, 273/403, 408, 404, 386, 390, 391, 392

[56] References Cited

U.S. PATENT DOCUMENTS 4,119,317 10/1978 Ohlund et al. ..... 273/406
4,288,080 9/1981 Laporte et al. .
4,330,129 5/1982 Meredith ..... 273/406

OTHER PUBLICATIONS

"Dixi" advertisement, 1984, Feb. 1984.

Mede '80, Erfolg und Protest, Internationale Wehrrevue Sep. 1980, p. 1463.

*Primary Examiner*—Mark S. Graham
*Attorney, Agent, or Firm*—Steven F. Caserza; Flehr Hohbach Test Albritton & Herbert LLP

[57] ABSTRACT

The invention relates to a target arrangement having a carrier frame which includes a housing receiver for a control unit located in a cuboidal housing, and which furthermore includes a housing-receiver for two drive units one beside the other, said drive units being accommodated in a cuboidal drive housing, or for one such drive unit in a central position, a shaft of the drive unit projecting out of the drive housing on one side, and it being possible for the drive housing, which is square on the two opposite end sides adjacent to the side on which a shaft projects, to be received by the housing-receiver with said shaft projecting laterally or upwardly, it being possible for the shaft to have connected to it a target-retainer, which is fastened on an angled arm or an adapter piece, it being possible for the arm and the adapter piece to be plugged onto the shaft.

36 Claims, 7 Drawing Sheets

TARGET SYSTEM

RELATED APPLICATIONS

This application is related to U.S. patent application Ser. No. 08/610,143 filed Feb. 29, 1996, abandoned, (attorney docket number A63038) entitled "TARGET ARRANGEMENT", and Ser. No. 08/610,142 filed Feb. 29, 1996, U.S. Pat. No. 5,868,396, (attorney docket number A63039) entitled "MOVABLE TARGET FOR SHOOTING PRACTICE".

BACKGROUND OF THE INVENTION

The invention relates to a target arrangement.

Target arrangements which comprise a carrier frame which receives a drive, arranged in a drive housing, and a control unit arranged in a control housing, allowing for a target borne by a target-retaining means to be pivoted, by means of the drive, out of a neutral position into a target position, are known. However, target arrangements of this type are not versatile, but are designed only for certain applications, for example only for pivoting a target out of a horizontal position into a vertical position or for rotating a target about a vertical axis.

SUMMARY

The object of the invention is to provide a target arrangement which can be assembled without difficulty, using correspondingly standardized parts, for as many applications as possible. A target arrangement of this type is suitable for swinging up one or more targets, for rotating one or more targets (if desired with friend/foe image on the front and rear sides), for the combined swinging up and rotating of targets, for turning one or more targets, for attaching a rollover-bar arrangement, for quick changeover and for easy exchange of targets.

BRIEF DESCRIPTION OF THE DRAWINGS

The invention is explained in more detail hereinbelow with reference to an exemplary embodiment shown in the accompanying drawings, in which.

DETAILED DESCRIPTION

Figure 1:
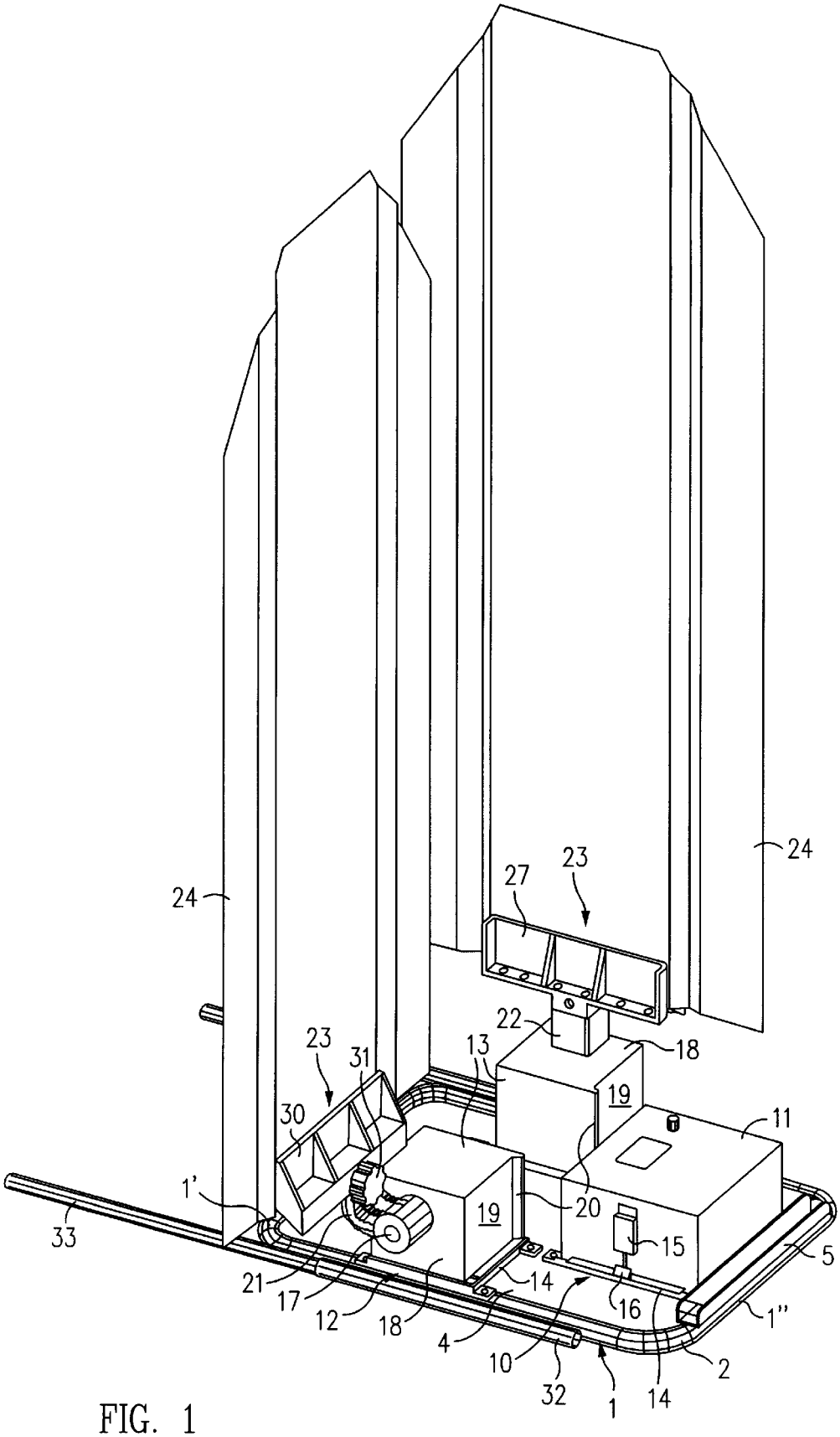
FIG. 1 shows, schematically and in perspective, an embodiment of a target arrangement in accordance with the present invention.

The target arrangement shown in FIG. 1 comprises a carrier frame 1 which is approximately rectangular and comprises a peripheral tube 2 with a transverse strut 3, and if desired, a base plate 4.

The transverse strut 3 is spaced apart by a distance of approximately ⅕ to ¼ of the overall distance between the two frame parts 1', 1", the latter being parallel to said transverse strut, from one of these frame parts 1'. In each case one U-shaped receiving profile 5 is provided on the transverse strut 3 and on the other frame part 1", the receiving profile 5 fastened on the frame part 1" being open towards the top and the receiving profile 5 fastened on the transverse strut 3 being open towards the frame part 1'.

Figure 2:
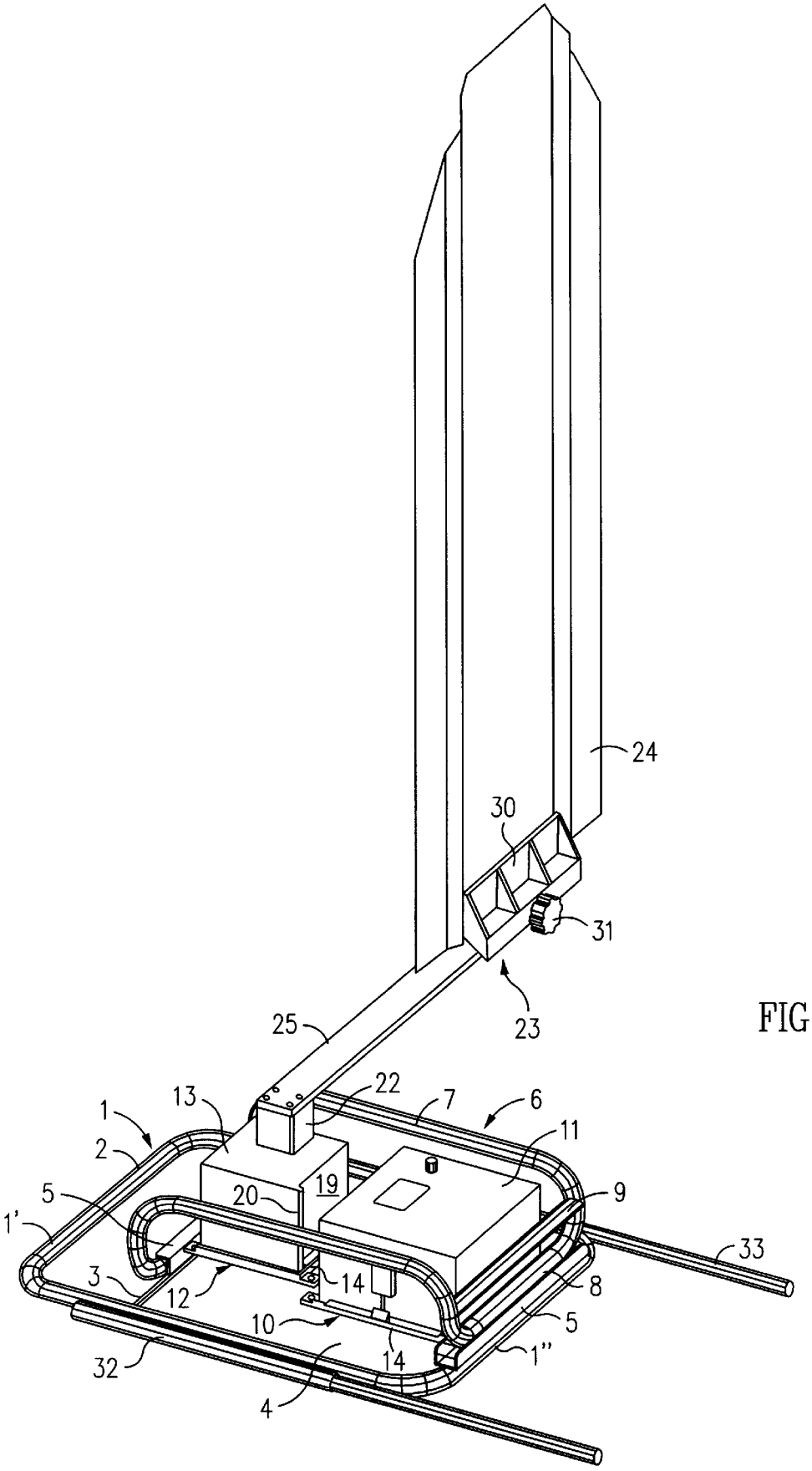
FIG. 2 shows, schematically and in perspective, a further embodiment of a target arrangement in accordance with the present invention.

The two receiving profiles 5 serve to receive a rollover bar 6, such as is shown in FIG. 2. The rollover bar 6 is designed in the form of a bent, continuous tube section, such that two spaced-apart parallel bar parts 7 and two plug-in sections 8 for plugging into the receiving profiles 5 are formed. One or more transverse struts 9 may be provided.

The carrier frame 1 comprises a housing-receiver 10 for a control unit located in a cuboidal housing 11, and furthermore comprises a housing-receiver 12 for drive units (for example, battery-operated electric motors) which are controlled by the control unit, each accommodated in a cubic drive housing 13. The housing-receiver 10 and 12 each comprise L-shaped (or U- shaped or Z-shaped) moldings 14 fastened on the base plate 4 (or corresponding struts).

In the exemplary embodiments, the moldings 14 for the housing 11 run perpendicularly with respect to the frame parts 1', 1" and receive the housing 11 between them. On the two sides which face the moldings 14, the housing 11 is provided with quick-action closures 15, of which the hook-like clamping members 16 engage on the moldings 14 and brace the housing 11 with respect to the same.

The moldings 14, provided parallel to the transverse strut 3, (FIG. 2) for drive housing 13 can be attached in three different positions, such that it is possible for two drive housings 13 to be received on the right and left at a distance from one another (FIG. 1) or for a single drive housing 13 to be received on the right, in the center (FIG. 2), or on the left.

The drive unit received by the drive housing 13 has a shaft 17 which projects out of the drive housing 13, on one side 18. On two opposite end sides 19 adjacent to the side 18, is located, on the one hand, a quick-action closure 15 (not visible) and, on the other hand, an extending edge 20, one edge being located on two adjacent sides and said edges forming a right angle which is open towards the shaft 17.

The respective extending edges 20 of the two drive housings 13 shown in FIG. 1 are pushed beneath the moldings 14 adjacent to the housing 11, such that the shaft 17 of the drive housing on the left in FIG. 1 is directed outward and the drive 17 of the drive housing 13 on the right in FIG. 1 is directed upwards. The quick-action closures 15 engage on the moldings 14 parallel thereto, with the result that the drive housing 13 are received in a fixed manner by the frame. The quick-action closures 15 are fastened rotatably on the drive housings 13 (centrally with respect to the end side 19), in order that said drive housings can be fastened in the two possible positions, rotated through 90°, using only one quick-action closure 15.

In alternative embodiments, the drive housings 13 are arranged such that the shafts 17 are directed outward, away from one another, or such that they are both directed upwards.

As shown in the embodiment of to FIG. 1, an angled arm 21 is plugged onto the horizontal shaft 17 and an adapter piece 22 is plugged on to the vertical shaft 17. In each case one target-retainer 23 for in each case one target 24 is fastened by means of screws on the arm 21 and the adapter piece 22.

By means of the left-hand shaft 17, a target 24 can be moved out of a horizontal, rearwardly or frontwardly directed position into the depicted vertical position, whereas, by means of the right-hand shaft 17, a target 24 can be rotated to the right or left through 90° out of a neutral position, in which the narrow side of the target 24 faces the marksman, in order to present the front or rear side (which may be provided with a friend or foe image). The drive units are actuated via the control unit.

As FIG. 2 shows, in one embodiment a horizontal web 25 is fastened by one end on the adapter piece 22, which web bears, at the free end, a target-retainer 23 and at least one target 24. Consequently, the target 24 may be turned, for example through 180° in the web plane into a door-like opening or the like.

Figure 3:
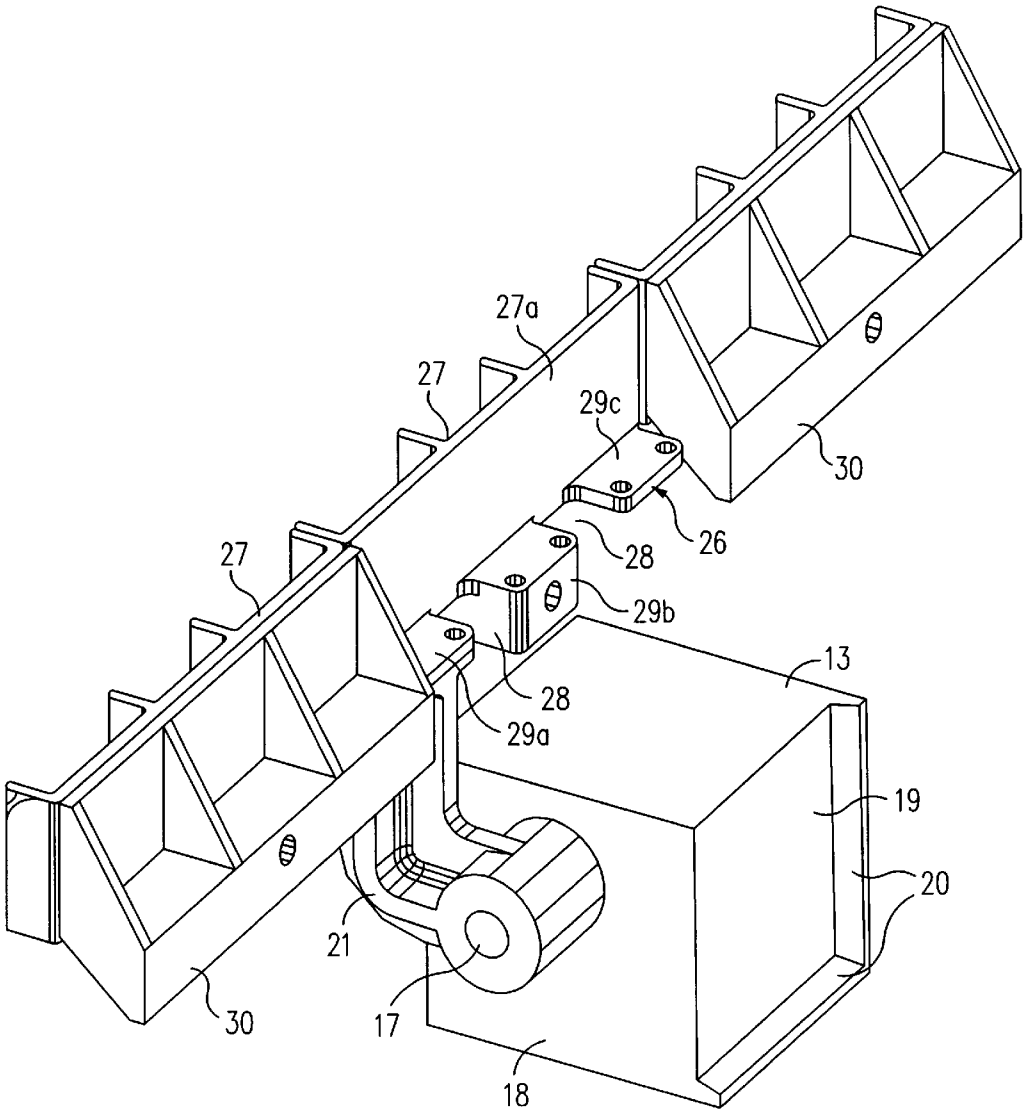
FIG. 3 shows, in perspective, a detail of a further embodiment of a target arrangement.

As shown in the embodiment of FIG. 3, the target-retainer 23 comprises a foot plate 26 on which there is fastened a fixed clamping piece 27 which includes an abutment surface 27*a*, which is perpendicular with respect to the upper side of the foot plate 26 and is intended for a target 24. The foot plate 26 and clamping piece 27 may also be designed in one piece.

The foot plate 26 includes two clearances 28 which separate a right-hand, a central and a left-hand fastening link 29*a*, 29*b*, 29*c* from one another, said links each being provided with screw through-passage holes arranged in the same way. It is thus possible for the foot plate 26 to be fastened on the arm 21 or the adapter piece 22 (FIG. 2) via one of the fastening links 29*a*, 29*b*, 29*c*.

The target-retainer 23 further comprises a loose clamping piece 30 which, being guided by the fastening links 29*a*, 29*b*, 29*c*, can be pushed onto the foot plate 26, against the fixed clamping piece 27, a target 24 which is positioned on the foot plate 26 being clamped in the process, and can be screwed tight in the pushed-on position by a clamping screw 31 (see FIGS. 1 and 2). In order to receive the clamping screw 31, the central fastening link 29*b* is designed to be correspondingly thicker than the two adjacent fastening links 29*a*, 29*c*.

The target-retainer 23, i.e. the fixed clamping pieces 27, can be extended by way of screws, with the result that, for example, as is depicted in FIG. 3, three units of target-retainer 23 may be arranged one beside the other, which three units are fastened together on one arm 21 and can receive two targets 24 one beside the other, these targets being moved together by the arm 21. In this embodiment, the loose clamping piece 30 for the central fixed clamping piece 27 may be dispensed with.

Figure 4:
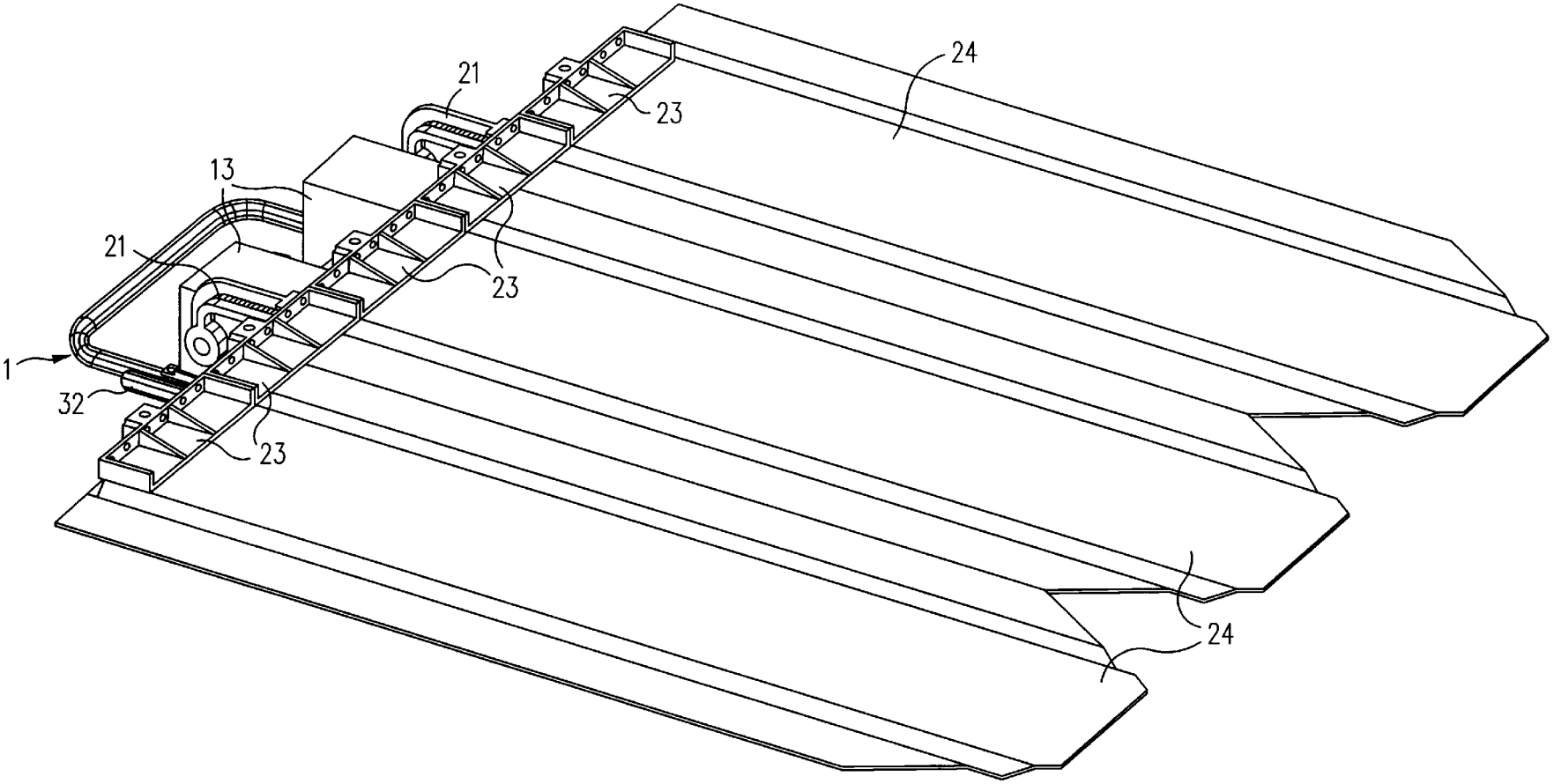
FIG. 4 shows, in perspective, an additional variant of the target arrangement of this invention.

However, as is shown in FIG. 4, it is also possible for, for example, five units of target retainer 23 to be connected to one another and fastened on two arms 21 of two drive units, in order to receive a total of three targets arranged one beside the other, which targets can be pivoted, by means of the two drive units, through 90° into an upright position out of a neutral position in which they are tilted over towards the housing 11 (as depicted in FIG. 4) or out of a position in which they are pivoted through 180° with respect to the position shown in FIG. 4.

On the two longitudinal sides, the carrier frame 1 includes in each case one tube 32 which, for its part, receives an elongate, optionally tubular supporting rod 33 (FIG. 2), which extends the respective tube 32 towards one side or the other in order to provide the target arrangement with additional stability even when the targets 24 are being pivoted or have been swung down, as may be expedient, for example, on uneven terrain.

In an alternative embodiment, instead of being mounted separately, it is also possible for the moldings 14 (FIG. 2) to be part of the corresponding frame.

The carrier frame 1 used in the embodiments of FIGS. 5 to 8 is likewise designed in the form of a tube structure, which, here, comprises a U-shaped tube bar 1*a*, with a connecting strut 1*b* at the end of the tube bar 1*a*, as well as the transverse strut 3, parallel to said connecting strut 1*b*, at a distance from the central leg of the tube bar 1*a*. The base 4 is arranged in the region between the connecting strut 1*b* and the transverse strut 3 and comprises, for example, two base plates which are fastened on the tube bar 1*a* at the top and bottom and may possibly receive reinforcement profiles between them.

The rollover bar 6 is likewise designed as a tube structure, and comprises two U-shaped bar parts 34 which are connected to one another by transverse struts 35. The bar parts 34 each include two feet 36 which are open towards the bottom. In one embodiment, the rollover bar 6 is narrower than the carrier frame 1 by somewhat more than double the thickness of the tube of said carrier frame 1.

Two stubs 37 (FIG. 7) are fastened on the connecting strut 1*b* of the carrier frame 1 such that they are spaced apart by the distance between the feet 36 of the rollover bar 6, with the result that the rollover bar 6 can be plugged onto the stubs 37 by means of its feet 36 and can be secured there by means of securing pins (not shown) plugged through the respective foot 36 and the stub 37, received by the latter.

The other two feet 36 of the rollover bar 6 are longer, by the tube thickness of the struts 1*b*, 3, than the feet which receive the stubs 37. Moreover, the width of the rollover bar 6 is such that it fits between the parallel legs of the tube bar 1*a*. An L-profile 38 is fastened on that side of the transverse strut 3 which is remote from the connecting strut 1*b*, the lower horizontal leg of which L-profile serves as standing surface or stop surface for those feet 36 of the rollover bar 6 which are situated there and for that transverse strut 35 of the rollover bar 6 which is located there. In particular, the rollover bar 6 is in clamping-type engagement with the L-profile 38.

Figure 6:
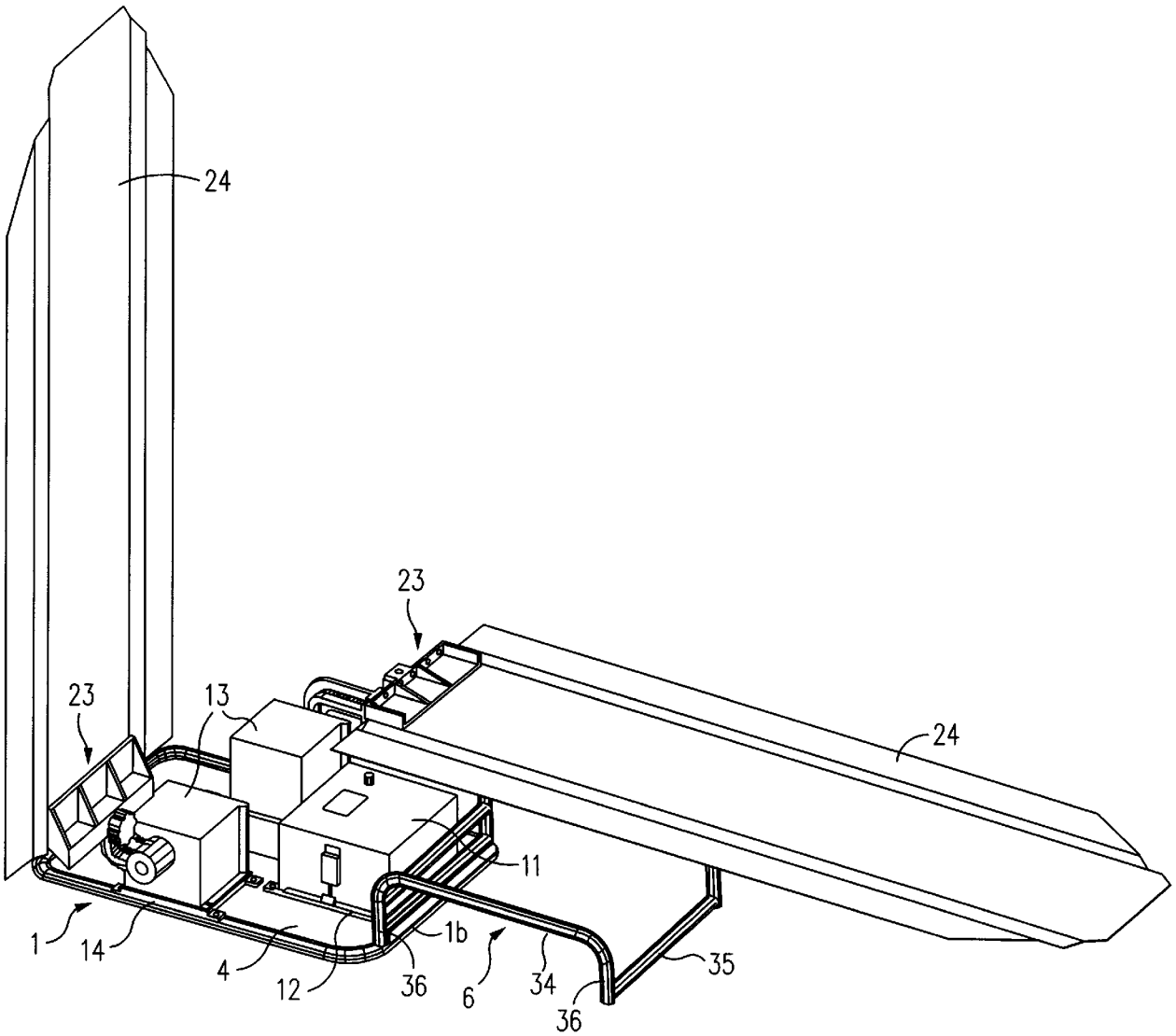
Figure 7:
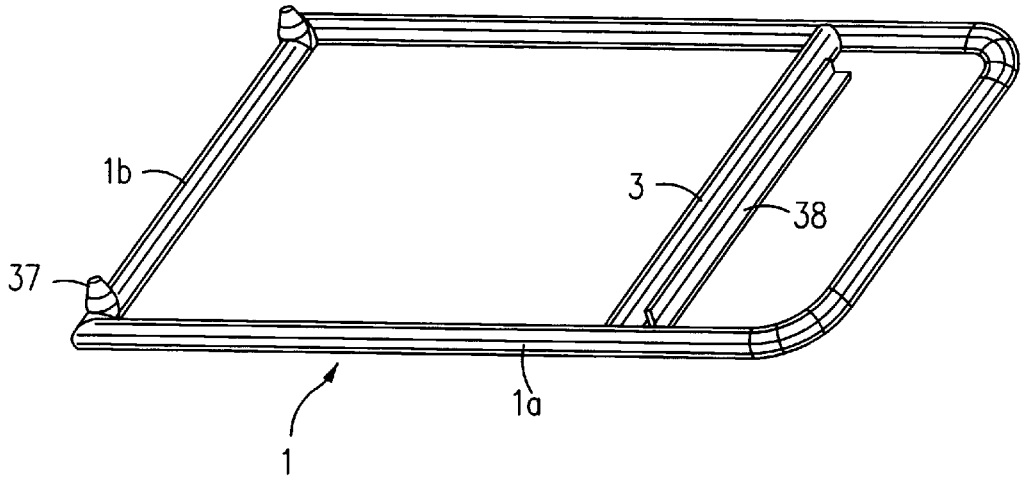
FIG. 7 shows, in perspective, one embodiment of a carrier frame for the target arrangements of FIGS. 5 and 6.
Figure 8:
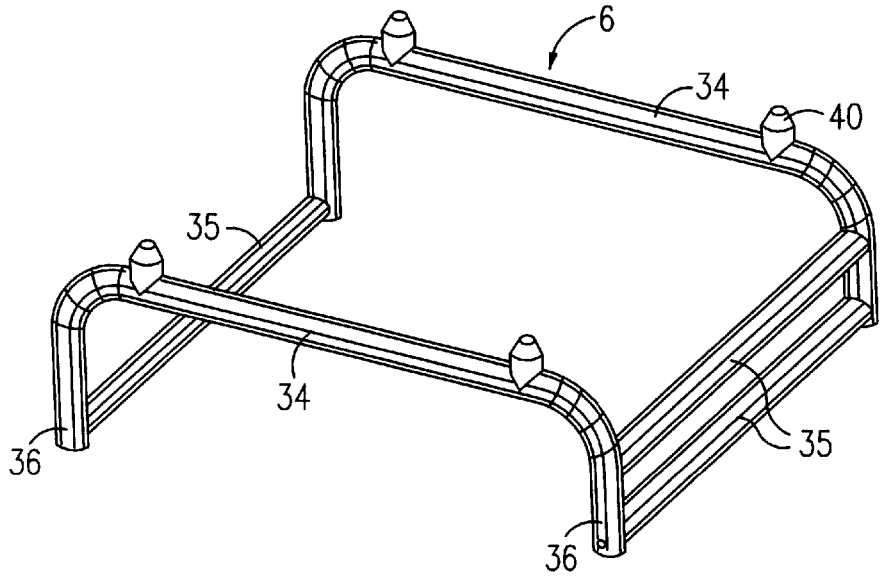
FIG. 8 shows, in perspective, one embodiment of a rollover bar for the target arrangements of FIGS. 5 and 6.

By virtue of the securing pins being released, the rollover bar 6 can be easily removed from the carrier frame 1 and, when it is rotated through 180° in the horizontal plane, it can be plugged onto the stubs 37 again, by means of the shorter feet 36, and secured, with the result that the standing surface of the target arrangement is correspondingly increased (see also FIG. 6 in this connection).

Of course, it is also possible for the longer feet 36 to be plugged onto the stubs 37, for example if corresponding unevenness in the terrain are to be compensated for.

The base 4 has four holes 39 for receiving stubs 40 fastened on the upper side of the rollover bar 6, in order for it to be possible to stack a plurality of target arrangements (without targets 24), which each comprise a carrier frame 1, a rollover bar 6, a control unit 11 and one or two drives 13, i.e. without arm(s) 21 and without target-retainer 23 and target(s) 24, one on top of the other, for example for transportation purposes, without the risk of them slipping.

In an alternative embodiment, a C-profile is used instead of the L-profile 38, which C-profile is open towards the central leg of the tube bar 1*a* and serves to receive that transverse strut 35 of the rollover bar 6 which is arranged between the ends of the longer feet.

Figure 5:
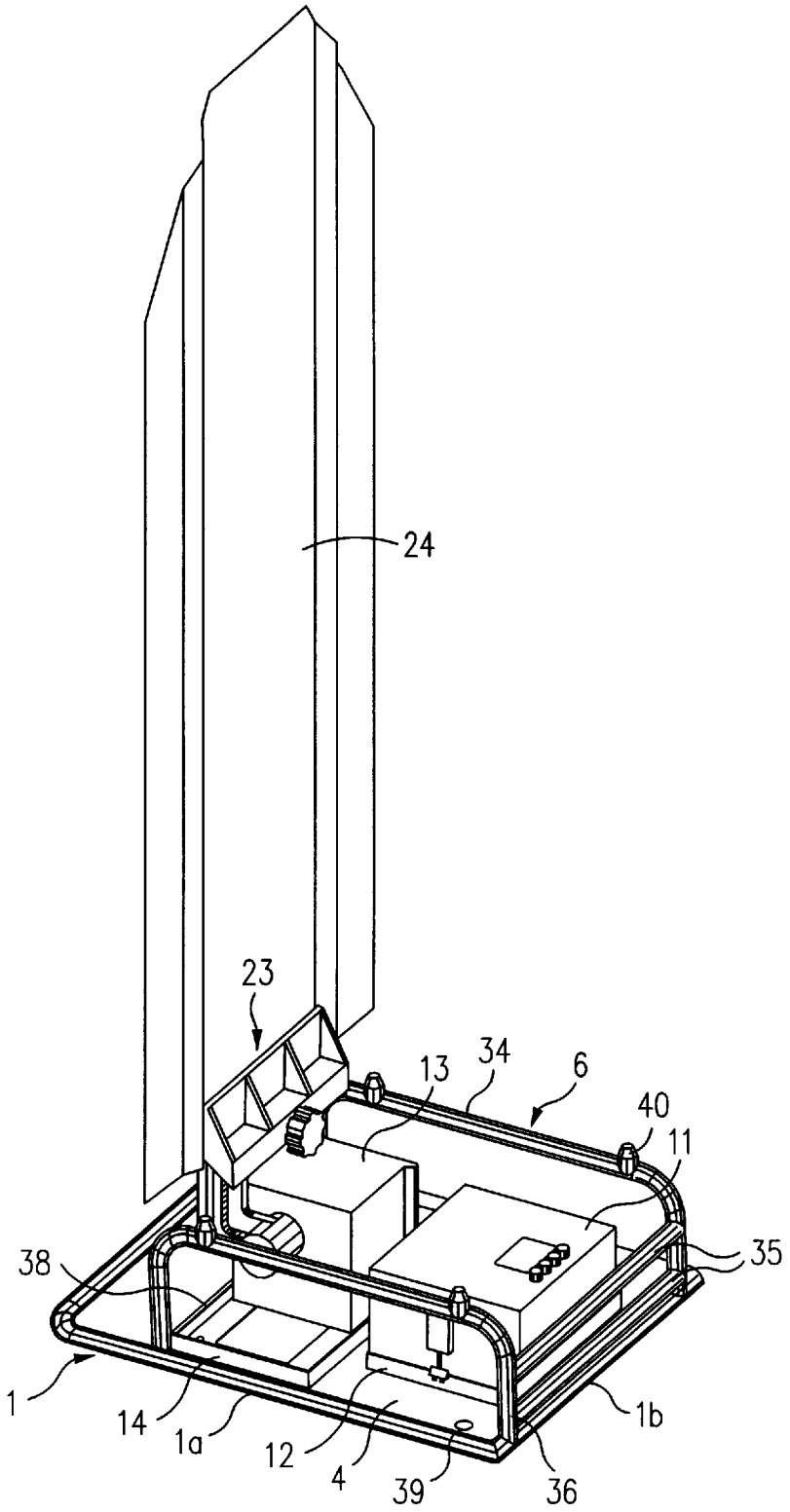
FIGS. 5 and 6 show, in perspective, further target arrangements in accordance with the present invention.

Instead of the L-profile 38, the transverse strut 3 may, if desired, likewise bear stubs 37, with the result that all four feet 36 of the rollover bar 6 receive a stub 37 when the rollover bar 6 is used as such and not in order to extend the carrier frame 1 (see FIG. 5).

FIG. 6 shows a target arrangement which, unlike FIG. 5, bears two drives 13 for the independent pivoting of two targets 24. As in the embodiments of FIGS. 1 to 4, the carrier frame 1 has corners which are rounded overall.

Provided on the connecting strut 1*b* is a C-profile 41 which is open towards the top and is intended for the plug-in attachment, if desired in a clamping manner, of a transverse strut 35 located between the ends of two feet 36 of the two bar parts 34, it being possible for said transverse strut to be secured on the carrier frame 1, if desired, for example by securing pins.

Adjacent to the targets 24, in this case, an L-profile 38 or a further C-profile or a pair of stubs 37, as in the exemplary embodiment of FIG. 5, may be provided on the carrier frame 1, for example on the transverse strut 3 thereof.

Since, according to the embodiments of FIGS. 5 to 8, a carrier frame 1 with a rollover bar 6, which is connected releasably to the latter and is intended for protecting drive(s) 13 and control unit 11 for the target(s) 24, is provided, protection against damage is afforded. Since the rollover bar 6 has two bar parts 34, which are spaced apart by transverse struts 35 and have two feet 36, and is connected releasably to the carrier frame 1, at least on that side of the latter which is remote from the target 24, via a plug-in connection for the feet 36 and/or transverse struts 35 which, together with mating pieces on the carrier frame 1, form releasable plug-in connections, the rollover bar 6, once it has been released, can be rotated through 180° in the horizontal plane or displaced by the length of the rollover bar 6, and positioned on the latter again, in order to extend the carrier frame 1, as a result of which the standing surface is considerably increased on the other hand. This makes it possible to reduce the weight of the target arrangement correspondingly, since the stability is ensured by a large standing surface.

The invention now being fully described, it will be apparent to one of ordinary skill in the art that many changes and modifications can be made thereto without departing from the spirit or scope of the appended claims.

What is claimed is:

1. A target system comprising:

a carrier frame;

a drive receiving device formed as part of said carrier frame and extending in a direction across said carrier frame;

one or more drives, each being provided within a drive housing and having a shaft extending out of said drive housing on only one side thereof;

said drive housing or housings each having opposite quadratic end faces generally perpendicular to said side said shaft is extending out;

each of said drive housing or housings being engageable with said drive receiving device in two different drive positions, a first position in which said drive shaft is extending upwardly from said drive housing or housings and a second position in which said drive shaft is extending sidewardly from said drive housing or housings; and a target retainer associated with each shaft.

2. A target system according to claim 1, wherein said carrier frame comprises a peripheral tube with at least one transverse strut.

3. A target system according to claim 1, wherein said carrier frame comprises a receiver for the releasable attachment of a rollover bar.

4. A target system according to claim 1, wherein said drive housing has a quick action closure attached to a first side thereof, and wherein the target system further comprises a housing-receiver which comprises at least one moulding, said quick-action closure engaging said moulding to releasably secure said drive housing to said carrier frame.

5. A target system according to claim 4, wherein said quick-action closure is fastened rotatably on the drive housing.

6. A target system according to claim 4, wherein said drive housing includes, on a second side opposite said first side, two forwardly extending edges, adjacent to one another, which form an angle which is open towards the shaft, and wherein said housing-receiver further comprises a second moulding spaced from said one moulding shaped to engage one of the forwardly extending edges of the drive housing.

7. A target system as in claim 1 which further comprises an adapter or arm connecting each said shaft with an associated target retainer.

8. A target system according to claim 7, wherein said target-retainer comprises a fixed clamping mountable to the arm or adapter piece and a target positioned between said fixed clamping piece and a loose clamping piece to clamp a target to said target-retainer.

9. A target system according to claim 8, wherein said clamping pieces can be lined up one beside the other at the spacing of two drive housings for the purpose of connection to the shafts of said drive housing or housings, said drive housing or housings being received by the carrier frame at a distance from one another.

10. A target system according to claim 8, wherein said target-retainer can be fastened in different positions on the arm or adapter.

11. A target system according to claim 7, wherein said arm comprises an adapter and a web which is screwed thereon.

12. A target system according to claim 7, wherein said carrier frame comprises lateral tubes having first and second ends, said first and second ends being adapted to receive an elongate supporting rod.

13. A target system according to claim 3, wherein said rollover bar has a pair of side frames spaced apart by transverse struts, said rollover bar being connected releasably to a side of said carrier frame remote from said target retainer by a plug-in connection such that the rollover bar can be plugged onto the carrier frame in order to extend the carrier frame.

14. A target arrangement system according to claim 13, wherein said rollover bar comprises feet which engage mating pieces on the carrier frame to form releasable plug-in connections.

15. A target system according to claim 14, wherein, the carrier frame includes two stubs positioned to engage said feet of the rollover bar, the feet being tubular and open towards the bottom.

16. A target system according to claim 13, wherein said rollover bar includes a first transverse strut and said carrier frame includes a second strut on said side of said carrier frame remote from said target, said plug-in connection being provided by said first transverse strut of the rollover bar and said second strut on said carrier frame.

17. A target system according to claim 16, which further comprises a C-profile connector for receiving the first transverse strut, said C-profile connector being fastened on the strut of the carrier frame.

18. A target system according to claim 3, wherein the carrier frame includes a securing device positioned on a side of said carrier frame proximate said target retainer for additionally retaining the rollover bar in a rollover protection position.

19. A target system according to claim 18, wherein said securing device comprises a clamping device.

20. A target system according to claim 18, wherein said securing device comprises an L-profile member which supports the rollover bar when said rollover bar is in a rollover protection position.

21. A target system according to claim 20, wherein the rollover bar includes first feet configured to engage stubs on the carrier frame and second feet spaced from said first feet, said first feet being shorter than the second feet essentially by the thickness of a carrier frame.

22. A target system according to claim 18, wherein said securing device comprises a C-profile connector shaped to receive a transverse web of the rollover bar.

23. A target system according to claim 18, wherein said securing device comprises a stub-type securing means.

24. A target system according to claim 18, wherein said securing device is carried by a transverse strut of the carrier frame.

25. A target system according to claim 3, wherein said carrier frame comprises a base which is provided with a plurality of holes arranged in a predetermined pattern, the rollover bar including stubs on its upper side which are capable of plugging into the holes of the base during stacking of target systems.

26. A target system according to claim 3, wherein said carrier frame and the rollover bar are formed of tubular members.

27. A target system as in claim 1 which comprises two of said drive housings, each engaging an associated one of said drive housing receivers.

28. A target system as in claim 1 which comprises one said drive housing, and engaging two of said drive housing devices.

29. A target system as in claim 1 wherein said drive housings are cuboidal.

30. A target system as in claim 1 which further comprises:

a control unit housing supported by said carrier frame; and a control unit located in said housing.

31. A target system as in claim 30 wherein said control unit housing is cuboidal.

32. A target system as in claim 1 wherein said drive receiving device is adapted to receive at least one of said housings with said quadratic end faces in an upwardly extending position and parallel to the direction said drive receiving device is extending across said carrier frame, either one drive housing being in a middle position with respect to the width of said carrier frame or two drive housings being in an adjacent relationship with respect to the width of said carrier frame.

33. A target system comprising:

a carrier frame having a front end, a back end, and first and second sides extending between said front end and said back end, said carrier frame including a housing-receiver adapted to receive at least one drive unit with said at least one drive unit selectively positioned in one of a first side position located proximate said first side of said carrier frame, a second side position located proximate said second side of said frame, and a middle position between the first side position and the second side position;

at least one drive unit engaging said housing receiver in a selected one of the first side position, the second side position and the middle position, said drive unit including a cuboidal drive housing and a shaft projecting from said drive housing, said drive housing being shaped to engage said housing receiver when said drive housing is in a first position with said shaft projecting in an upward orientation relative to said carrier frame and a second position with said shaft projecting in a lateral orientation relative to said carrier frame; and a target retainer coupled to said shaft.

34. A target system according to claim 33, wherein said target system comprises two drive units carried by said carrier frame each having a drive housing engaging a housing-receiver and a shaft projecting therefrom.

35. The target system of claim 27, and further comprising a second drive unit engaging said housing receiver in another one of the first side position, the second side position, and the middle position, said second drive unit including a cuboidal second drive housing and a second shaft projecting from said second drive housing, said second drive housing being shaped to engage said housing receiver when said second drive housing is in a first position with said second shaft projecting in an upward orientation relative to said carrier frame and a second position with said second shaft projecting in a lateral orientation relative to said carrier frame.

36. A target system as in claim 33 wherein said two drive receivers allow at least one drive housing to be attached in a selected one of the first side position, the second side position and the middle position.

* * * * *